US009456657B2

(12) United States Patent
Barnes et al.

(10) Patent No.: US 9,456,657 B2
(45) Date of Patent: Oct. 4, 2016

(54) ARTICLE OF FOOTWEAR WITH SUPPORT ASSEMBLY HAVING TUBULAR MEMBERS

(71) Applicant: NIKE, Inc., Beaverton, OR (US)

(72) Inventors: Elizabeth Barnes, Portland, OR (US); Margarita Cortez, Beaverton, OR (US); Zachary Elder, Portland, OR (US); Fred Fagergren, Hillsboro, OR (US); Lee Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 248 days.

(21) Appl. No.: 13/955,605

(22) Filed: Jul. 31, 2013

(65) Prior Publication Data

US 2015/0033579 A1 Feb. 5, 2015

(51) Int. Cl.
*A43B 13/18* (2006.01)

(52) U.S. Cl.
CPC ..... *A43B 13/185* (2013.01); *A43B 13/181* (2013.01)

(58) Field of Classification Search
CPC . A43B 13/181; A43B 13/183; A43B 13/185
USPC ..... 36/27, 28, 83
See application file for complete search history.

(56) References Cited

U.S. PATENT DOCUMENTS 3,204,913 A * 9/1965 Lawrence et al. ..... 248/570
4,536,974 A * 8/1985 Cohen ..... 36/28
4,611,412 A * 9/1986 Cohen ..... 36/28
4,753,021 A 6/1988 Cohen
4,774,774 A * 10/1988 Allen, Jr. ..... 36/28
4,782,603 A * 11/1988 Brown ..... 36/29
4,843,737 A * 7/1989 Vorderer ..... 36/38
4,914,836 A * 4/1990 Horovitz ..... 36/28
5,353,526 A * 10/1994 Foley et al. ..... 36/92
5,461,800 A * 10/1995 Luthi ..... A43B 13/206 36/114
D376,471 S * 12/1996 Kalin et al. ..... D2/760
5,588,165 A * 12/1996 Fromme ..... 5/247
5,822,886 A 10/1998 Luthi et al.
5,826,352 A 10/1998 Meschan et al.
5,871,298 A * 2/1999 Lekhtman et al. ..... 402/77
6,568,102 B1 * 5/2003 Healy et al. ..... 36/28
6,807,753 B2 * 10/2004 Steszyn et al. ..... 36/28
6,886,274 B2 * 5/2005 Krafsur et al. ..... 36/27
7,334,351 B2 * 2/2008 Hann ..... 36/27
7,398,608 B2 7/2008 Schoenborn
7,444,767 B2 * 11/2008 Kilgore et al. ..... 36/30 R
7,565,754 B1 * 7/2009 Acheson et al. ..... 36/28
7,673,397 B2 * 3/2010 Jarvis ..... 36/28
8,261,469 B2 * 9/2012 Aveni et al. ..... 36/28
2002/0163114 A1 * 11/2002 Lobry et al. ..... 267/142
2004/0049946 A1 * 3/2004 Lucas et al. ..... 36/28
2004/0128860 A1 * 7/2004 Smaldone et al. ..... 36/28
2004/0148799 A1 * 8/2004 Lussier et al. ..... 36/28

(Continued)

*Primary Examiner* — Richale Quinn
*Assistant Examiner* — Anne Kozak
(74) *Attorney, Agent, or Firm* — Banner & Witcoff, Ltd.

(57) ABSTRACT

An article of footwear includes an upper and a support assembly positioned beneath the upper, and having a top plate, a bottom plate, and a plurality of connecting members. The connecting members are spaced from one another and extend partway inwardly from a periphery of the support assembly such that connecting members on a medial side of the support assembly are spaced from connecting members on a lateral side of the support assembly, with each connecting member including a primary aperture extending therethrough. Each of a plurality of tubular members has a central aperture passing therethrough and is received in the primary aperture of one of the connecting members.

24 Claims, 6 Drawing Sheets

(56) References Cited

U.S. PATENT DOCUMENTS

2004/0154189 A1* 8/2004 Wang ..... 36/28
2005/0028403 A1* 2/2005 Swigart et al. ..... 36/28
2005/0252038 A1 11/2005 Braunschweiler
2006/0064900 A1* 3/2006 Aveni ..... 36/28
2006/0065499 A1* 3/2006 Smaldone et al. ..... 188/372
2006/0112592 A1* 6/2006 Leedy et al. ..... 36/29
2006/0191162 A1* 8/2006 Aveni et al. ..... 36/28
2006/0201028 A1 9/2006 Chan et al.
2006/0254087 A1* 11/2006 Fechter ..... 36/27
2006/0277791 A1 12/2006 Schoenborn et al.
2006/0277792 A1 12/2006 Schoenborn
2006/0283047 A1 12/2006 Schoenborn et al.
2006/0288612 A1* 12/2006 Lucas et al. ..... 36/28
2007/0022628 A1* 2/2007 Juan ..... 36/3 B
2007/0028484 A1* 2/2007 Akhidime ..... 36/28
2007/0033830 A1* 2/2007 Chang ..... 36/28
2007/0033833 A1* 2/2007 Chang et al. ..... 36/30 R
2007/0074423 A1* 4/2007 Goodwin et al. ..... 36/29
2007/0113425 A1 5/2007 Wakley et al.
2007/0119074 A1* 5/2007 Aveni et al. ..... 36/27
2007/0193065 A1* 8/2007 Nishiwaki et al. ..... 36/27
2007/0199213 A1* 8/2007 Campbell et al. ..... 36/102
2007/0266593 A1* 11/2007 Schindler et al. ..... 36/28
2007/0277395 A1* 12/2007 Aveni et al. ..... 36/27
2008/0016718 A1* 1/2008 Aveni et al. ..... 36/28
2008/0034615 A1* 2/2008 Nishiwaki et al. ..... 36/88
2008/0148598 A1 6/2008 Schoenborn
2008/0155861 A1* 7/2008 Lucas et al. ..... 36/103
2008/0196277 A1* 8/2008 Cook et al. ..... 36/137
2008/0244926 A1* 10/2008 Yu et al. ..... 36/28
2008/0256827 A1* 10/2008 Hardy et al. ..... 36/27
2008/0289224 A1* 11/2008 Sink ..... 36/103
2009/0064542 A1* 3/2009 Figueroa ..... 36/136
2009/0100705 A1* 4/2009 Cook et al. ..... 36/29
2009/0126224 A1* 5/2009 Greene et al. ..... 36/27
2009/0158622 A1* 6/2009 Cook et al. ..... 36/137
2009/0241370 A1* 10/2009 Kimura ..... 36/28
2009/0241377 A1* 10/2009 Kita et al. ..... 36/107
2011/0289799 A1* 12/2011 Keating et al. ..... 36/103
2012/0090200 A1* 4/2012 Cook ..... 36/103
2014/0068966 A1* 3/2014 Chaffin ..... 36/28
2015/0033577 A1* 2/2015 Dahl et al. ..... 36/28
2015/0167768 A1* 6/2015 Zhao

* cited by examiner

ARTICLE OF FOOTWEAR WITH SUPPORT ASSEMBLY HAVING TUBULAR MEMBERS

FIELD

Aspects of this invention relate generally to an article of footwear with an improved sole assembly and, in particular, to an article of footwear having a support assembly having a plurality of connecting members including tubular members.

BACKGROUND

Conventional articles of athletic footwear generally include two primary elements, an upper and a sole structure. The upper is secured to the sole structure and forms a void on the interior of the footwear for comfortably and securely receiving a foot. The sole structure is secured to a lower portion of the upper and is positioned between the foot and the ground. The sole structure generally incorporates multiple layers that are conventionally referred to as an insole, a midsole, and an outsole. The insole, or sockliner, is a thin, compressible member located within the void and proximate a lower surface of the foot to enhance footwear comfort.

The outsole forms a ground-engaging portion (or other contact surface-engaging portion) of the sole structure, and is formed from a durable and wear-resistant material that includes texturing to improve traction.

To keep a wearer safe and comfortable, footwear is called upon to perform a variety of functions. For example, the sole structure of footwear should provide adequate support and impact force attenuation properties to prevent injury and reduce fatigue, while at the same time provide adequate flexibility so that the sole structure articulates, flexes, stretches, or otherwise moves to allow an individual to fully utilize the natural motion of the foot.

The midsole, which is conventionally secured to the upper along the length of the upper, forms a middle layer of the sole structure and is primarily responsible for attenuating ground (or other contact surface) reaction forces to lessen stresses upon the foot and leg, may also beneficially utilizing such ground reaction forces for more efficient toe-off, and control potentially harmful foot motions, such as over pronation. Conventional midsoles may include a foam material to attenuate impact forces and absorb energy when the footwear contacts the ground during athletic activities. Other midsoles may utilize fluid-filled bladders (e.g., filled with air or other gasses) to attenuate impact forces and absorb energy.

Stabilization is also a factor in sports like basketball, volleyball, football, and soccer. In addition to running, an athlete may be required to perform a variety of motions including transverse movement; quickly executed direction changes, stops, and starts; movement in a backward direction; and jumping. While making such movements, footwear instability may lead to excessive inversion or eversion of the ankle joint, potentially causing an ankle sprain.

High-action sports, such as soccer, basketball, football, rugby, ultimate, etc., impose special demands upon players and their footwear. Accordingly, it would be desirable to provide footwear that achieves better dynamic control of the wearer's movements, while at the same time providing impact-attenuating features that protect the wearer from excessive impact loads.

It would be desirable to provide an article of footwear with a sole assembly that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide a support assembly having connecting members including tubular members that provides improved shock-attenuation and energy-absorption for an article of footwear. In accordance with a first aspect, an article of footwear includes an upper and a support assembly positioned beneath the upper, and having a top plate, a bottom plate, and a plurality of connecting members. The connecting members are spaced from one another and extend partway inwardly from a periphery of the support assembly such that connecting members on a medial side of the support assembly are spaced from connecting members on a lateral side of the support assembly, with each connecting member including a primary aperture extending therethrough. Each of a plurality of tubular members has a central aperture passing therethrough and is received in the primary aperture of one of the connecting members.

In accordance with another aspect, an article of footwear includes an upper, a support assembly positioned beneath the upper and including a top plate having a base member with a peripheral edge and a peripheral wall extending upwardly from the peripheral edge. A bottom plate is positioned below the top plate. A plurality of connecting members extend between the top plate and the bottom plate about a periphery of the support assembly and are spaced from one another such that gaps are formed between adjacent connecting members. The connecting members extend partway inwardly from a periphery of the support assembly such that connecting members on a medial side of the support assembly are spaced from connecting members on a lateral side of the support assembly, with each connecting member including a primary aperture extending therethrough. Each of a plurality of tubular members has a central aperture passing therethrough and is received in the primary aperture of one of the connecting members. A midsole has a first midsole portion positioned above a forward portion of the support assembly and a second midsole portion positioned beneath a forefoot portion of the upper. An outsole is positioned beneath the support assembly and the second midsole portion.

In accordance with a further aspect, an article of footwear includes an upper and a support assembly positioned beneath the upper. The support assembly includes a top plate having a base member with a peripheral edge and a peripheral wall extending upwardly from the peripheral edge, and a bottom plate positioned below the top plate. A plurality of connecting members extend between the top plate and the bottom plate about a periphery of the support assembly and are spaced from one another such that gaps are formed between adjacent connecting members, the connecting members extending partway inwardly from a periphery of the support assembly such that connecting members on a medial side of the support assembly are spaced from connecting members on a lateral side of the support assembly. Each connecting member includes a primary aperture extending therethrough. A medial flange extends forwardly and downwardly from a forward medial edge of the top plate and is connected to the bottom plate. A lateral flange extends forwardly and downwardly from a forward lateral edge of the top plate and is connected to the bottom plate. Each of a plurality of tubular members has a central aperture passing therethrough and is received in the primary aperture of one of the connecting members, and is formed of a first material having a density less than a density of a second material that is used to form the top plate, the bottom plate, and the connecting members. A midsole having a first midsole portion positioned above a forward portion of the support assembly and a second midsole portion positioned beneath a forefoot portion of the upper. An outsole is positioned beneath the support assembly and the second midsole portion.

By providing improved shock-attenuation and energy-absorption for an article of footwear, the performance and comfort of the footwear can be enhanced. These and additional features and advantages disclosed here will be further understood from the following detailed disclosure of certain embodiments.

Figure 1:
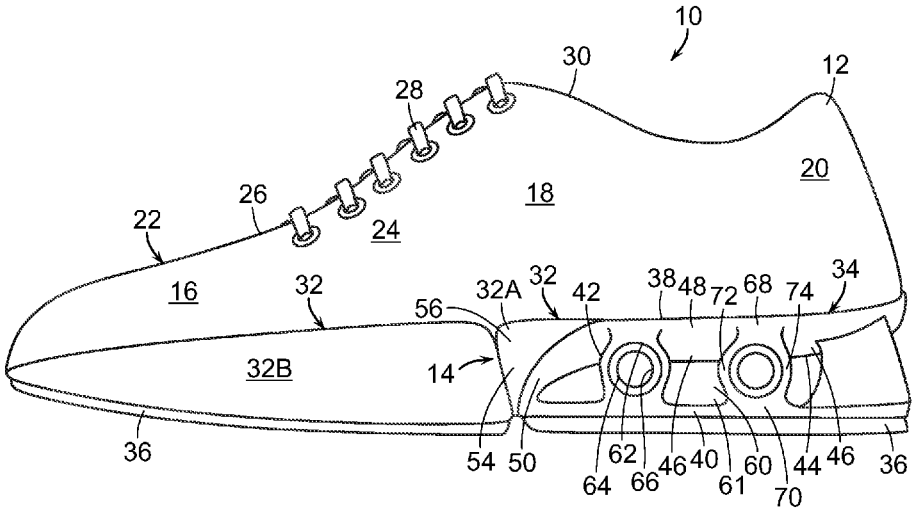
FIG. 1 is an elevation view of an article of footwear having a support assembly including a chamber assembly with a plurality of sealed chambers.
Figure 2:
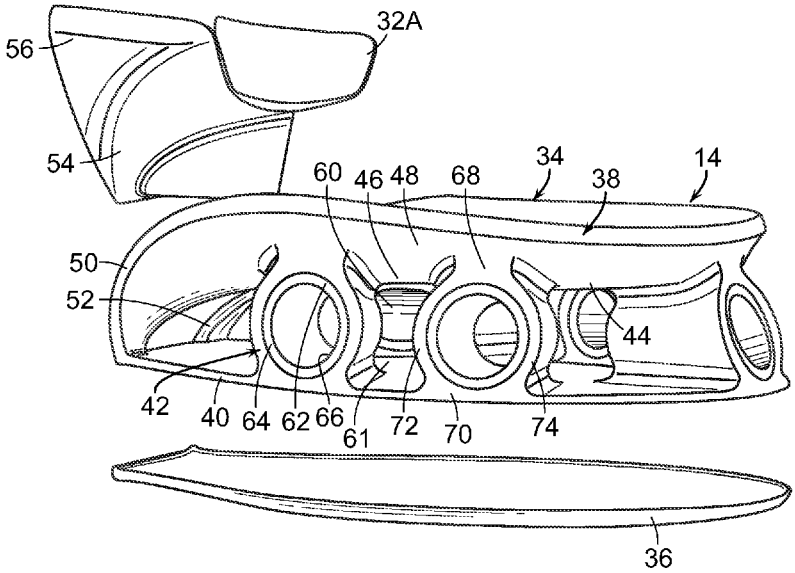
FIG. 2 is a perspective view in exploded form of the support assembly of the footwear of FIG. 1.
Figure 3:
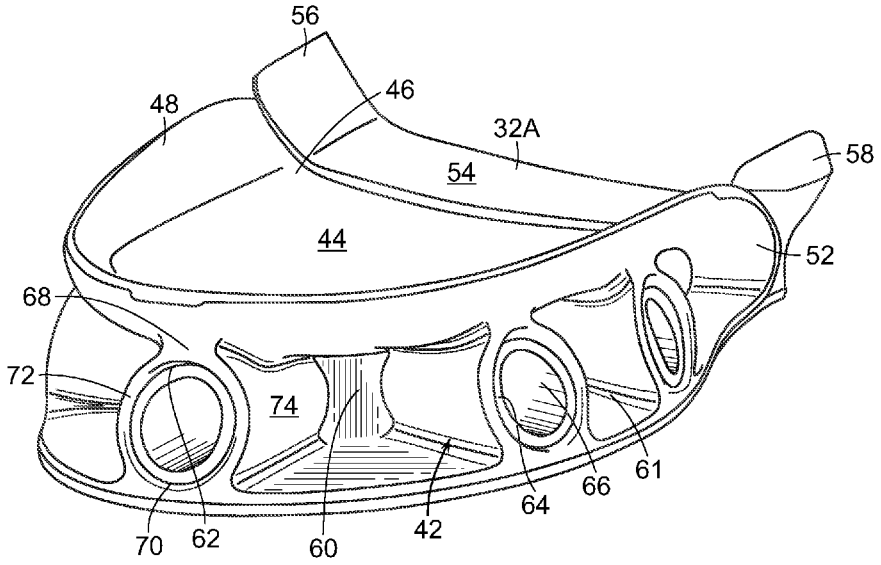
FIG. 3 is a perspective view of the support assembly of FIG. 1, shown in a static condition.

The figures referred to above are not drawn necessarily to scale, should be understood to provide a representation of particular embodiments of the invention, and are merely conceptual in nature and illustrative of the principles involved. Some features of the footwear with a support assembly having connecting members including tubular members depicted in the drawings have been enlarged or distorted relative to others to facilitate explanation and understanding. The same reference numbers are used in the drawings for similar or identical components and features shown in various alternative embodiments. Footwear with a support assembly having connecting members including tubular members as disclosed herein would have configurations and components determined, in part, by the intended application and environment in which they are used.

DETAILED DESCRIPTION OF CERTAIN PREFERRED EMBODIMENTS

An article of footwear 10 is depicted in FIG. 1 as including an upper 12 and a sole assembly 14. For purposes of reference in the following description, footwear 10 may be divided into three general regions: a forefoot region 16, a midfoot region 18, and a heel region 20. Regions 16-20 are not intended to demarcate precise areas of footwear 10. Rather, regions 16-20 are intended to represent general areas of footwear 10 that provide a frame of reference during the following discussion. Although regions 16-20 apply generally to footwear 10, references to regions 16-20 also may apply specifically to upper 12, sole assembly 14, or individual components within either upper 12 or sole assembly 14.

Upper 12 defines a void or chamber for receiving a foot. For purposes of reference, upper 12 includes a lateral side 22, an opposite medial side 24, and a vamp or instep area 26. Lateral side 22 is positioned to extend along a lateral side of the foot (i.e., the outside) and generally passes through each of regions 16-20. Similarly, medial side 24 is positioned to extend along an opposite medial side of the foot (i.e., the inside) and generally passes through each of regions 16-20. Upper 12 may also include a closure mechanism, such as lace 28. Upper 12 also includes an ankle opening 30 that provides the foot with access to the void within upper 12.

Upper 12 may also include an insole (or sockliner, not shown), which is generally a thin, compressible member located within the void for receiving the foot and proximate to a lower surface of the foot. Typically, the insole, which is configured to enhance footwear comfort, may be formed of foam, and optionally a foam component covered by a moisture wicking fabric or textile material. Further, the insole or sockliner may be glued or otherwise attached to the other components of footwear 10, although it need not be attached, if desired.

Sole assembly 14 includes a midsole 32 positioned below upper 12. Midsole 32 may be formed of a resilient, polymer foam material, such as polyurethane or ethylvinylacetate ("EVA") foam, polyurethane foam, phylon foam, and phylite foam. In some more specific examples of this invention, the midsole 32 will be at least partially made from a foam material having a density of less than 0.25 g/cm3 (and in some examples, a density of less than 0.2 g/cm3, within the range of 0.075 to 0.2 g/cm3, and even within the range of 0.1 to 0.18 g/cm3). If desired, the foam material may include one or more openings defined therein and/or another impact-force attenuating component included with it, such as a fluid-filled bladder.

As some even more specific examples, at least some of midsole 32 may be made from a foam material as described, for example, in U.S. Pat. No. 7,941,938, which patent is entirely incorporated herein by reference. In at least some embodiments, all, substantially all, or at least some portion of midsole 32 may include a foam material comprising a reaction product of about 10 to about 100 parts per hundred hydrogenated or non-hydrogenated acrylonitrile butadiene copolymer, 0 to about 40 parts per hundred modified hydrogenated acrylonitrile butadiene copolymer, and 0 to about 90 parts per hundred alpha olefin copolymer, and at least one additive in an amount suitable to form the foam material. This foam material may have a lightweight, spongy feel. The density of the foam material may be generally less than 0.25 g/cm3, less than 0.20 g/cm3, less than 18 g/cm3, less than 0.15 g/cm3, less than 0.12 g/cm3, and in one aspect, about 0.10 g/cm3. As example ranges, the foam density may fall within the range, for example, of 0.05 to 0.25 g/cm3 or within the various ranges noted above.

Also, in accordance with at least some embodiments, the resiliency of the foam material for midsole 32 may be greater than 40%, greater than 45%, at least 50%, and in one aspect from 50-70%. Compression set may be 60% or less, 50% or less, 45% or less, and in some instances, within the range of 20 to 60%. The hardness (Durometer Asker C) of the foam material for this example midsole 32 may be, for example, 25 to 50, 25 to 45, 25 to 35, or 35 to 45, e.g., depending on the type of footwear. The tensile strength of midsole 32 may be at least 15 kg/cm2, and typically 15 to 40 kg/cm2. The elongation % is 150 to 500, typically above 250. The tear strength is 6-15 kg/cm, typically above 7. In at least some example constructions according to the invention, the foam material of at least some portion of midsole 32 may have lower energy loss and may be more lightweight than traditional EVA foams. The energy loss may be less than 30%, and optionally within the range of about 20% to about 30%. As additional examples, if desired, at least some portion of midsole 32 may be made from foam materials used in the LUNAR family of footwear products available from NIKE, Inc. of Beaverton, Oreg.

Other suitable materials for midsole 32 will become readily apparent to those skilled in the art, given the benefit of this disclosure. In certain embodiments, it is to be appreciated that midsole 32 may incorporate sealed chambers, fluid-filled bladders.

Midsole 32 may be directly secured to upper 12 with an adhesive, for example. Suitable adhesives are well known in the art and need not be discussed in greater detail here. Midsole 32 may be secured to upper 12 with any other suitable fastening means, and such other suitable means of midsole 32 to upper 12 will become readily apparent to those skilled in the art, given the benefit of this disclosure.

Midsole 32 may extend beneath the length and width of upper 12. In the illustrated embodiment, midsole 32 includes a first midsole portion 32A extending from heel portion 20 forwardly beneath midfoot portion 18, and a second midsole portion 32B extending from midfoot portion 18 forwardly beneath forefoot portion 16.

A support assembly 34 is positioned below midsole 32. Support assembly 34 serves to provide shock-attenuation and energy-absorption for footwear 10. In the embodiment illustrated here, support assembly 34 extends from heel portion 20 to midfoot portion 18, and is positioned beneath first midsole portion 32A. It is to be appreciated that support assembly 34 can extend beneath the entirety of midsole 32 and upper 12 or any portions thereof. It is to be further appreciated that support assembly 34 could include two or more separate portions positioned at any desired location along footwear 10.

An outsole 36 is positioned below support assembly 34 as well as below second midsole portion 32B in forefoot portion 16. Outsole 36 may be secured to support assembly 34 and midsole 32 with an adhesive, for example. Suitable adhesives are well known in the art and need not be discussed in greater detail here. Other suitable means of fastening outsole 36 to support assembly 34 and midsole 32 will become readily apparent to those skilled in the art, given the benefit of this disclosure.

Suitable materials for outsole 36 include any of the conventional rubber materials that are utilized in footwear outsoles, such as carbon black rubber compound. Other suitable materials for outsole 36 will become readily apparent to those skilled in the art, given the benefit of this disclosure.

In certain embodiments, outsole 36 may be formed of a layer of material secured to and extending over the bottom surface of support assembly 34 and a layer of material secured to and extending over the bottom surface of second midsole portion 32B. In other embodiments, outsole 36 may be formed of a plurality of individual elements secured to the bottom surface of support assembly 34 and second midsole portion 32B.

As seen in FIGS. 2-5, support assembly 34 includes a top plate 38, a bottom plate 40, and a plurality of connecting members 42 extending between top plate 38 and bottom plate 40. Top plate 38 receives a rear portion of upper 12, and includes a base member 44 having a peripheral edge 46, and a peripheral wall 48 extending upwardly from peripheral edge 46. In certain embodiments, peripheral wall 48 is curved inwardly so as to wrap around a peripheral edge of upper 12.

A medial flange 50 extends forwardly and curves downwardly from a forward medial edge of top plate 38 to a forward medial edge of bottom plate 40, and a corresponding lateral flange 52 extends forwardly and curves downwardly from a forward lateral edge of top plate 38 to a forward lateral edge of bottom plate 40.

First midsole portion 32A includes a base member 54, a medial wall 56 extending upwardly from a medial edge of base member 54, and a lateral wall 58 extending upwardly from a lateral edge of base member 54.

Connecting members 42 extend about a periphery of top plate 38 and bottom plate 40 of support assembly 34. Each connecting member 42 extends inwardly only partway from the periphery of sole assembly 34 such that connecting members 42 on lateral side 22 are spaced from connecting members 44 on medial side 24, with a gap 60 formed there between. Adjacent connecting members 42 are spaced from one another about the periphery of support assembly 34 such that gaps 61 are formed there between.

Figure 4:
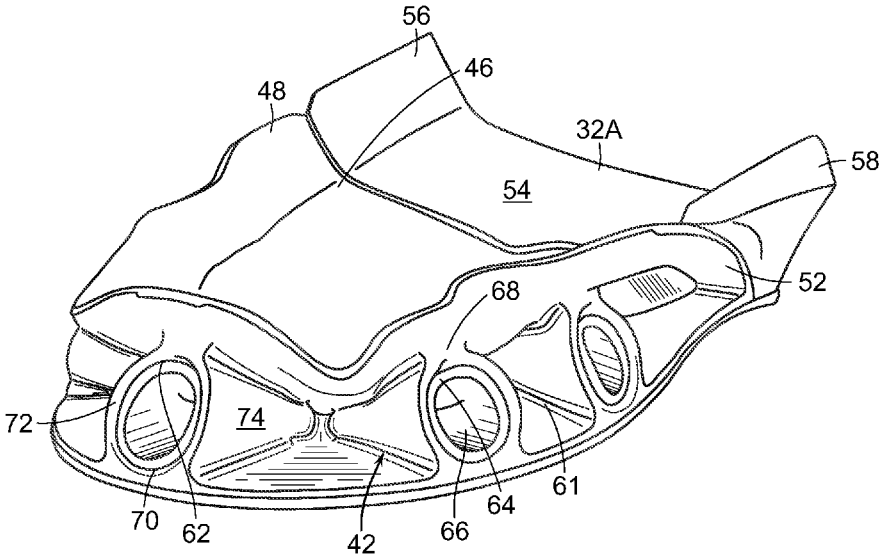
FIG. 4 is a perspective view of the support assembly of FIG. 1, shown under a compression load.
Figure 5:
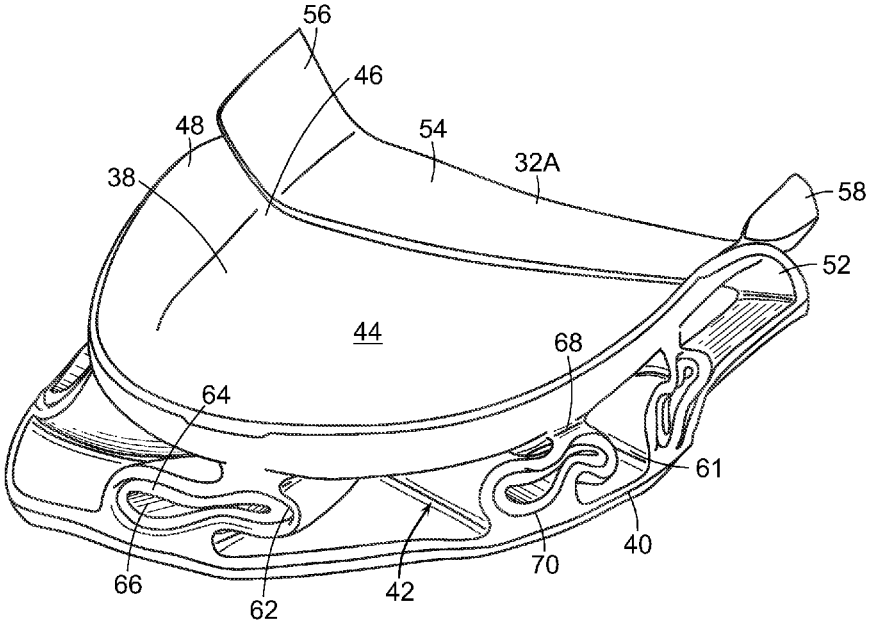
FIG. 5 is a perspective view of the support assembly of FIG. 1, shown under a shear load.

Each connecting members 42 includes a primary aperture 62 extending therethrough. A tubular member 64 is positioned within each primary aperture 62, with a central aperture 66 extending through each tubular member 64. As seen in the embodiment illustrated FIGS. 1-2, each tubular member 64 may be substantially cylindrical and circular in cross-section in a static condition. As seen in FIG. 4-5, it is to be appreciated that under compressive and shear loading, respectively, that the cross-section of tubular members 64, and correspondingly, connecting members 42, is compressed, or flattened.

Each connecting member 42 includes an upper portion 68 in contact with top plate 38, a lower portion 70 in contact with bottom plate 40, a first arm 72 extending between upper portion 68 and lower portion 70, and a second arm 74 extending between upper portion 68 and lower portion 70. Upper portion 68, lower portion 70, first arm 72 and second arm 74 cooperate to define primary aperture 62 of connecting member 42. Thus, in the illustrated embodiment, first arm 72 and second arm 74 are curved away from one another as they extend away from top plate 38 and bottom plate 40.

Figure 6:
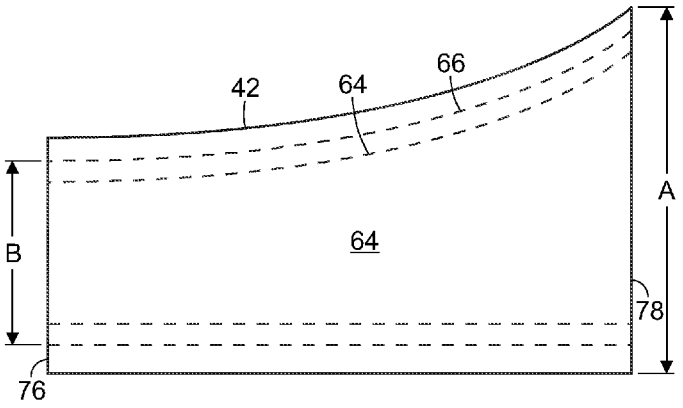
FIG. 6 is an elevation view of a connecting member of the support assembly of FIG. 1.

In certain embodiments, as illustrated in FIG. 6, connecting members 42 have a non-constant height A along their length, and, naturally, tubular members 64 also have a non-constant height B along their length. As seen in FIG. 6, the height of each connecting member 42 and tubular member 64 increases along its length from an inner end 76 in a central portion of support assembly 34 towards an outer end 78 thereof at the periphery of support assembly 34. Thus, as shown here, where tubular members 64 are substantially circular in cross-section, height B is also the diameter of tubular members 64, and increases from inner end 76 to outer end 78. Having a greater diameter at the periphery of support assembly 34 provides a cradling structure, which is particularly advantageous in heel portion 20 of footwear 10.

Figure 7:
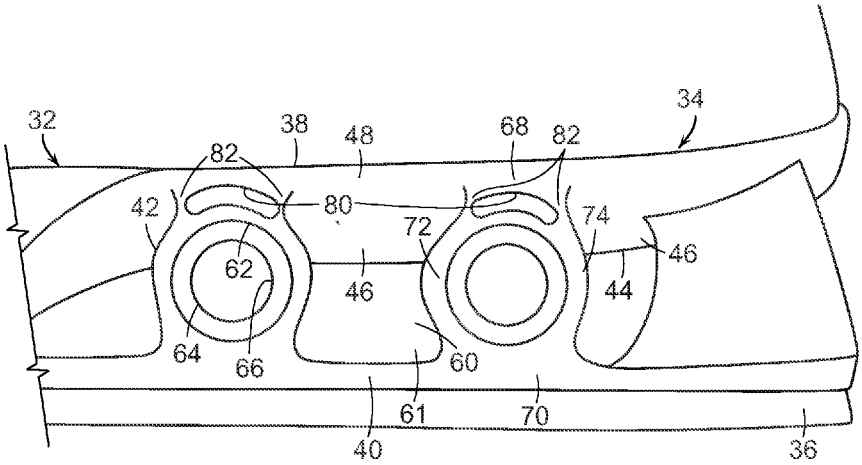
FIG. 7 is an elevation view, partially broken away, of an alternative embodiment of the support assembly of FIG. 1

In certain embodiments, as illustrated in FIG. 7, upper portion 68 of connecting member 42 may include an upper aperture 80 positioned above primary aperture 62 and extending through connecting member 42. Upper aperture 80 defines a pair of upper arms 82 of connecting member 42.

Figure 8:
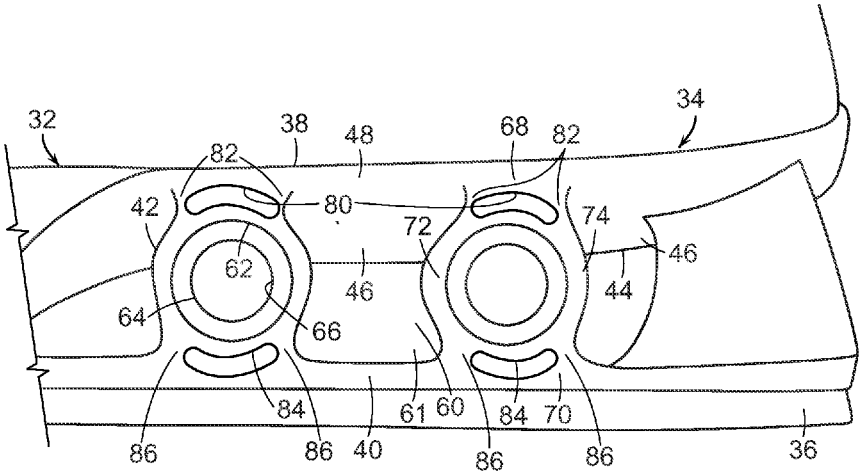
FIG. 8 is an elevation view, partially broken away, of another alternative embodiment of the support assembly of FIG. 1

As illustrated in FIG. 8, lower portion 70 of connecting member 42 may include a lower aperture 84 positioned below primary aperture 62 and extending through connecting member 42. Lower aperture 84 defines a pair of lower arms 86 of connecting member 42. Upper arms 82 and lower arms 86 provide additional loading points for support assembly 34, allowing additional customization of support assembly 34.

Upper aperture 80 and lower aperture 84 may take any desired shape and size. As illustrated here, upper and lower apertures 80, 84 are racetrack shaped arcuate slots, whose curvature matches that of primary aperture 62. It is to be appreciated that in other embodiments, upper and lower apertures 80, 84 could be circular, oval, or any other regular or non-regular shape. Upper and lower apertures 80, 84 can be sized such that upper arms 82 and lower arms 86 have any desired height and thickness, as well.

It is to be appreciated that any or all connecting members 42 may include either or both of upper aperture 80 and lower aperture 84, and that any combination of connecting members 42 with any combination of upper and lower apertures 80, 84 may be used in support assembly 34.

In certain embodiments, top plate 38, connecting members 42 and their constituent parts, and bottom plate 40 are of unitary or one-piece construction. That is, they are an entity made of a single material, as opposed to being formed from a plurality of parts secured together. Support assembly 34 may be formed in a mold, for example, in order to be formed of a single unitary material.

Support assembly 34 and, in particular, connecting members 42, as well as upper arms 82, upper aperture 80, lower aperture 82, and lower arms 84, cooperate to serve to attenuate ground reaction forces including compression loading and shear loading. The effect on support assembly 34 and connecting members 42 can be seen in FIGS. 3-5, where support assembly 34 is shown in a static condition, under compression loading, and under shear loading, respectively.

Support assembly 34 may allow bending or compression against impact forces in a first direction (e.g., in the direction of landing a step or a jump, in substantially the vertical direction, etc.) while providing resistance against shear forces in a second direction different from the first direction (e.g., in a side-to-side direction, substantially the horizontal direction, in the lateral to medial side direction, etc.), enhancing lateral stability. Such resistance to lateral or shear forces provides stability when a wearer quickly stops, cuts, or changes directions in the footwear.

It is to be appreciated that support assembly 34 can be customized, or optimized, in order to provide desired amounts of support and resistance to shear forces. For example, the diameter and thickness of tubular members 64 as well as their length and other properties can be varied to produce desired operating parameters. Further, the components of connecting members 42 can be varied as well. For example, the thickness, shape, and orientation of first arm 72 and second arm 74 can be varied, and the size of primary aperture 62 can be varied as well.

Figure 9:
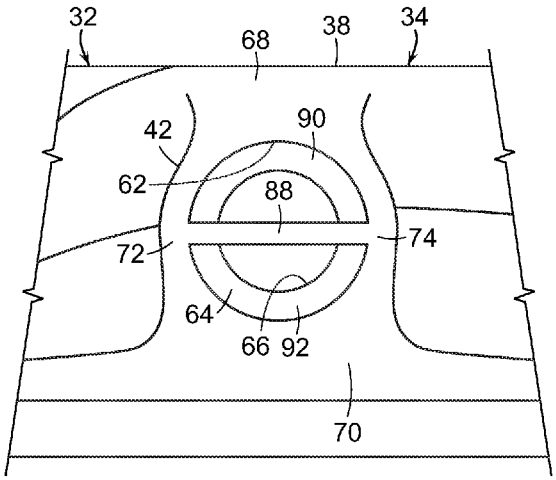
FIG. 9 is an elevation view, partially broken away, of an alternative embodiment of the connecting member of the support assembly of FIG. 1.
Figure 10:
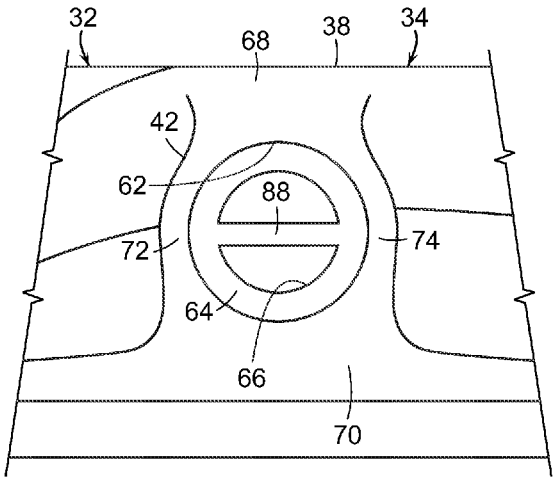
FIG. 10 is an elevation view, partially broken away, of a further alternative embodiment of the connecting member of the support assembly of FIG. 1.

Another embodiment of connecting member 42 is illustrated in FIG. 9, in which connecting member 42 includes a transverse member 88. In the illustrated embodiment, transverse member 88 extends between first arm 72 and second arm 74, bisecting tubular member 64 such that tubular member includes an upper portion 90 and a lower portion 92. In another embodiment, illustrated in FIG. 10, transverse member 88 extends across an interior of tubular member 64.

Figure 11:
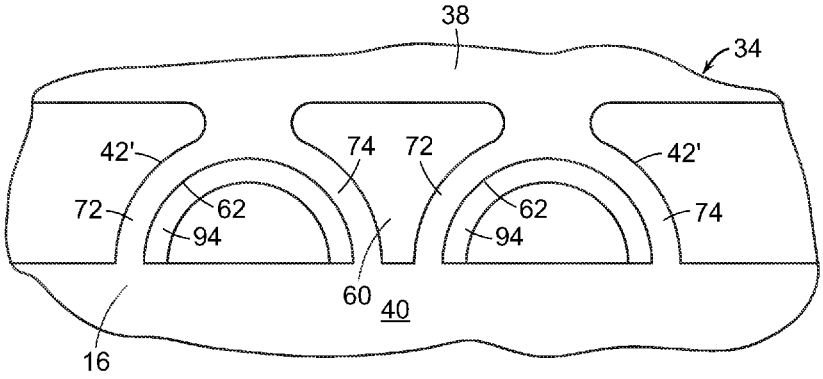
FIG. 11 is an elevation view, partially broken away, of an alternative embodiment of a forefoot region of the support assembly of FIG. 1.

In certain embodiments, as illustrated in FIG. 11, one or more forefoot additional connecting members 42' may be positioned in forefoot region 16 of support assembly 34. Due to the reduced height of forefoot region 16, these forefoot connecting members 42' include hemispherical members 94 positioned within primary apertures 62.

Figure 12:
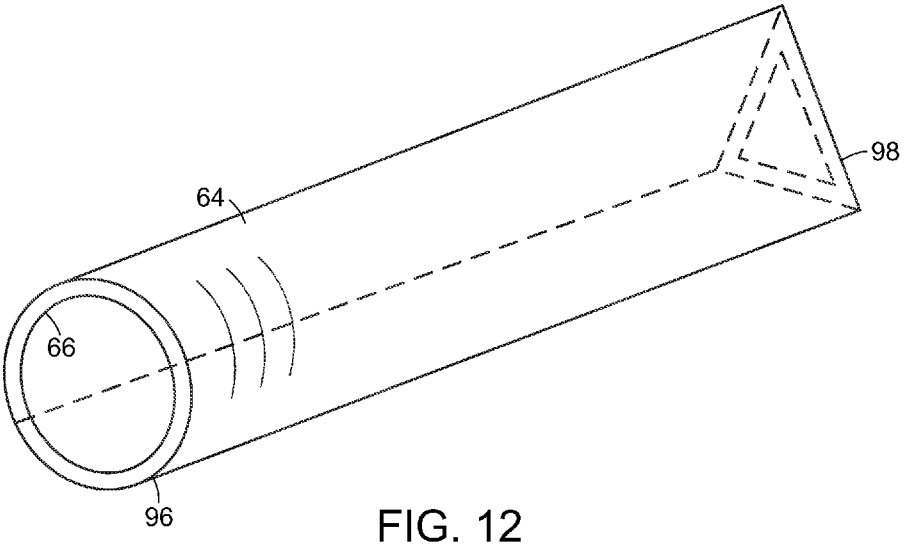
FIG. 12 is a perspective view of an alternative embodiment of a tubular member of the support assembly of FIG. 1.

In certain embodiments, as depicted in FIG. 12, the shape of a tubular member 64 may not be constant along its length. For example, tubular member 64 could vary from a first circular cross-section at its first end 96 to a second triangular cross-section at its second end 98. It is to be appreciated that second end 98 could have any desired cross-sectional shape.

In certain embodiments top plate 38, connecting members 42, and bottom plate 40 are formed of a polyether-block co-polyamide polymer, such as PEBAX®, available from Atofina Corporation of Puteaux, France, thermo plastic polyurethane (TPU), rubber, plastics, foamed plastics, and other polymers. It is to be appreciated that in certain embodiments, different portions of support assembly 34 can be made of different materials. For example, in certain embodiments, upper portion 68 of connecting member 42 may be formed of a material that is harder, or denser, than a material used to form lower portion 70 of connecting member 42. Similarly, top plate 38 and upper portions of first and second arms 72, 74 could be made of the harder material while lower plate 40 and lower portions of first and second arms 72, 74 could be made of the softer material. Other suitable materials for top plate 38, connecting members 42, and bottom plate 40 will become readily apparent to those skilled in the art, given the benefit of this disclosure.

It is also to be appreciated that the materials used to form support assembly 34 may vary from side to side of footwear 10. Thus, the material used to form one or more portions of lateral side 22 of support assembly 34 could be different than that used to form one or more portions of medial side 24. For example, the tubular members 64 on lateral side 22 could be harder than those on medial side 24.

In certain embodiments, tubular members 64 are formed of a resilient, polymer foam material, such as polyurethane or ethyl vinyl acetate ("EVA" or "injection phylon"). Tubular members 64 are preferably formed of a material that springs back or otherwise returns to its original shape after a load or forces are released. It is to be appreciated that in certain embodiments, tubular members may be formed of a material that is softer, or less dense, than a material used to form support assembly 34. Other suitable materials for tubular members 64 will become readily apparent to those skilled in the art, given the benefit of this disclosure.

In certain embodiments, tubular members 64 are formed of a first material having a first density while top plate 38, connecting members 42, and bottom plate 40 are formed of a second material having a second density that is greater than the first density, such that the second material is harder and stiffer than the first material. In other embodiments, the second material could be softer and more resilient than the first material.

In the illustrated embodiment, connecting members 42 are visible from an exterior of footwear 10. It is to be appreciated that in certain embodiments, connecting members 42 could be completely or partially contained within footwear 10 such that none, or only a part of, connecting members 42 are visible from an exterior of footwear 10.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising:

an upper;

a support assembly positioned beneath the upper and comprising:

a top plate;

a bottom plate positioned below the top plate;

a plurality of connecting members extending between the top plate and the bottom plate about a periphery of the support assembly, the connecting members extending partway inwardly from the periphery of the support assembly such that medial connecting members on a medial side of the support assembly are spaced from lateral connecting members on a lateral side of the support assembly, each connecting member including a primary aperture extending therethrough; and a plurality of tubular members, each tubular member having a central aperture passing therethrough and received in the primary aperture of one of the connecting members, wherein adjacent connecting members are spaced apart from one another about the periphery of the support assembly to define gaps between the adjacent connecting members, the gaps being free of material and extending from the top plate to the bottom plate, and wherein the plurality of connecting members includes:

a first lateral connecting member spaced from a forward end of the lateral side of the support assembly by one of the gaps;

a second lateral connecting member spaced from the first lateral connecting member by one of the gaps;

a first medial connecting member spaced from a forward end of the medial side of the support assembly by one of the gaps;

a second medial connecting member spaced from the first medial connecting member by one of the gaps; and a rear connecting member positioned in a rear of the support assembly and spaced from each of the second lateral connecting member and the second medial connecting member by one of the gaps.

2. The article of footwear of claim 1, wherein each connecting member comprises:

an upper portion in contact with the top plate;

a lower portion in contact with the bottom plate;

a first arm extending between the upper portion and the lower portion; and a second arm extending between the upper portion and the lower portion, a corresponding tubular member positioned between the first and second arms.

3. The article of footwear of claim 2, wherein the corresponding tubular member is in contact with the upper portion, the lower portion, the first arm, and the second arm.

4. The article of footwear of claim 2, wherein the first and second arms curve away from one another as they extend away from the top and bottom plates.

5. The article of footwear of claim 2, further comprising a transverse member extending between the first arm and the second arm.

6. The article of footwear of claim 1, wherein the top plate, the connecting members, and the bottom plate are of unitary construction.

7. The article of footwear of claim 1, further comprising:

a medial flange extending forwardly and downwardly from a forward medial edge of the top plate and connected to the bottom plate; and a lateral flange extending forwardly and downwardly from a forward lateral edge of the top plate and connected to the bottom plate.

8. The article of footwear of claim 1, wherein the tubular members are formed of a first material having a density less than a density of a second material that is used to form the top plate, the bottom plate, and the connecting members.

9. The article of footwear of claim 1, wherein the top plate includes a base member having a peripheral edge and a peripheral wall extending upwardly from the peripheral edge.

10. The article of footwear of claim 1, further comprising a midsole positioned beneath the upper.

11. The article of footwear of claim 10, wherein the midsole includes a first midsole portion positioned above a forward portion of the support assembly and a second midsole portion positioned beneath a forefoot portion of the upper.

12. The article of footwear of claim 1, further comprising an outsole positioned beneath the support assembly.

13. The article of footwear of claim 1, wherein at least one tubular member has a substantially circular cross-section.

14. The article of footwear of claim 1, wherein a height of at least one tubular member increases from a first end in a central portion of the support assembly to a second end at the periphery of the support assembly.

15. The article of footwear of claim 1, wherein at least one connecting member includes an upper aperture extending through the connecting member and positioned above the primary aperture.

16. The article of footwear of claim 1, wherein at least one connecting member includes a lower aperture extending through the connecting member and positioned above the primary aperture.

17. The article of footwear of claim 1, further comprising:

an additional connecting member located in a forefoot region of the support assembly and extending between the top plate and the bottom plate, and a hemispherical member positioned in a primary aperture of the additional connecting member.

18. The article of footwear of claim 1, further comprising a transverse member extending across an interior of at least one tubular member.

19. The article of footwear of claim 1, wherein a first end of at least one tubular member has a first cross-section section that is different than a second cross-section of a second end of the at least one tubular member.

20. An article of footwear comprising:

an upper;

a support assembly positioned beneath the upper and comprising:

a top plate including a base member with a peripheral edge and a peripheral wall extending upwardly from the peripheral edge;

a bottom plate positioned below the top plate;

a plurality of connecting members extending between the top plate and the bottom plate about a periphery of the support assembly and spaced from one another such that gaps are formed between adjacent connecting members, the gaps being free of material and extending from the top plate to the bottom plate, the connecting members extending partway inwardly from a periphery of the support assembly such that medial connecting members on a medial side of the support assembly are spaced from lateral connecting members on a lateral side of the support assembly, each connecting member including a primary aperture extending therethrough; and a plurality of tubular members, each tubular member having a central aperture passing therethrough and received in the primary aperture of one of the connecting members;

a midsole having a first midsole portion positioned above a forward portion of the support assembly and a second midsole portion positioned beneath a forefoot portion of the upper; and an outsole positioned beneath the support assembly and the second midsole portion, wherein the plurality of connecting members includes:

a first lateral connecting member spaced from a forward end of the lateral side of the support assembly by one of the gaps;

a second lateral connecting member spaced from the first lateral connecting member by one of the gaps;

a first medial connecting member spaced from a forward end of the medial side of the support assembly by one of the gaps;

a second medial connecting member spaced from the first medial connecting member by one of the gaps; and a rear connecting member positioned in a rear of the support assembly and spaced from each of the second lateral connecting member and the second medial connecting member by one of the gaps.

21. The article of footwear of claim 20, wherein the tubular members are formed of a first material having a density less than a density of a second material that is used to form the top plate, the bottom plate, and the connecting members.

22. The article of footwear of claim 20, wherein a height of at least one tubular member increases from a first end in a central portion of the support assembly to a second end at the periphery of the support assembly.

23. The article of footwear of claim 20, further comprising a midsole positioned beneath the upper.

24. An article of footwear comprising:

an upper;

a support assembly positioned beneath the upper and comprising:

a top plate including a base member with a peripheral edge and a peripheral wall extending upwardly from the peripheral edge;

a bottom plate positioned below the top plate;

a plurality of connecting members extending between the top plate and the bottom plate about a periphery of the support assembly and spaced from one another such that gaps are formed between adjacent connecting members, the gaps being free of material and extending from the top plate to the bottom plate, the connecting members extending partway inwardly from a periphery of the support assembly such that medial connecting members on a medial side of the support assembly are spaced from lateral connecting members on a lateral side of the support assembly, each connecting member including a primary aperture extending therethrough;

a medial flange extending forwardly and downwardly from a forward medial edge of the top plate and connected to the bottom plate;

a lateral flange extending forwardly and downwardly from a forward lateral edge of the top plate and connected to the bottom plate; and a plurality of tubular members, each tubular member having a central aperture passing therethrough and received in the primary aperture of one of the connecting members and formed of a first material having a density less than a density of a second material that is used to form the top plate, the bottom plate, and the connecting members a midsole having a first midsole portion positioned above a forward portion of the support assembly and a second midsole portion positioned beneath a forefoot portion of the upper; and an outsole positioned beneath the support assembly and the second midsole portion, wherein the plurality of connecting members includes:

a first lateral connecting member spaced from a forward end of the lateral side of the support assembly by one of the gaps;

a second lateral connecting member spaced from the first lateral connecting member by one of the gaps;

a first medial connecting member spaced from a forward end of the medial side of the support assembly by one of the gaps;

a second medial connecting member spaced from the first medial connecting member by one of the gaps; and a rear connecting member positioned in a rear of the support assembly and spaced from each of the second lateral connecting member and the second medial connecting member by one of the gaps.

* * * * *